United States Patent [19]

Prudenziati

[11] Patent Number: 4,642,922

[45] Date of Patent: Feb. 17, 1987

[54] REMOVABLE STEAM IRON SOLE PLATE

[75] Inventor: Giorgio Prudenziati, Borgosatollo, Italy

[73] Assignee: D.M.D.S.r.l., Italy

[21] Appl. No.: 806,275

[22] Filed: Dec. 6, 1985

[51] Int. Cl.[4] ..... D06F 75/38

[52] U.S. Cl. ..... 38/81; 38/93

[58] Field of Search ..... 38/81, 93, 77.9

[56] References Cited

U.S. PATENT DOCUMENTS

| | | | |
|---|---|---|---|
| 2,309,179 | 1/1943 | Ferris | 38/93 X |
| 2,582,773 | 1/1952 | Finlayson | 38/77.9 |
| 3,142,916 | 8/1964 | Jacobson | 38/93 |
| 3,930,325 | 1/1976 | Schaeffer et al. | 38/77.9 |
| 4,532,411 | 7/1985 | Terraillon et al. | 38/93 X |

*Primary Examiner*—Werner H. Schroeder
*Assistant Examiner*—Andrew M. Falik
*Attorney, Agent, or Firm*—McGlew and Tuttle

[57] ABSTRACT

An iron having a plate (1) to the base of which is fitted a thin sheet (2) of perforated stainless steel. A recess or housing (4) defined by a peripheral border (5) and a network of channels (6, 7) for uniform distribution of the steam are made in the bottom surface of the plate (1). The perforated sheet (2) is reinforced by ribs and is centred in the recess (4) and attached to the plate (1) by means of screws (18, 19) so that it can be removed and permit access to the channels (6, 7).

4 Claims, 6 Drawing Figures

REMOVABLE STEAM IRON SOLE PLATE

FIELD AND BACKGROUND OF THE INVENTION

The present invention relates to steam irons of the type having a perforated sole plate.

Of the various types of irons, in particular steam irons, those which have a sole plate, are already known. These sole plates are generally of aluminium or its alloys, and are fitted and supplemented at the base by means of a sheet of stainless steel which is perforated to allow the steam to escape from the foot of the iron. In accordance with a known embodiment the stainless steel sheet is rather thick, generally of some millimeters thickness, and is attached by being flanged around the entire length of the perimeter of the sole plate of the iron. A steel sheet of this type however gives rise to problems when forming the holes for escape of the steam because these are difficult to make by stamping in view of the thickness of the sheet. In addition to this, once the steel sheet has been fixed to the plate it cannot be removed and therefore impedes convenient and unrestricted access to and inspection of the steam chamber for any maintenance work required.

SUMMARY OF THE INVENTION

The object of this invention is therefore to provide a steam iron having a plate provided with a thin perforated stainless steel sheet which can be made easily and advantageously by stamping and which is removably attached to the plate by suitable means and can therefore be removed for replacement and in order to provide access to the steam chamber.

A further object of the invention is to provide an iron with an applied steel sheet which can overcome the inconveniences and disadvantages of embodiments in accordance with the above-mentioned known state of the art.

According to the present invention there is provided a steam iron comprising a sole plate on the base of which is provided a perforated stainless steel sheet, characterised in that a housing or recess bounded and surrounded by a perimeter border and having longitudinal and transverse channels for the passage of steam, is provided in the undersurface of the plate, and wherein the stainless steel sheet is seated and centered in the housing or recess and removably attached thereto.

BRIEF DESCRIPTION OF THE DRAWINGS

The present invention will be described further, by way of example, with reference to the accompanying drawings, in which.

DESCRIPTION OF THE PREFERRED EMBODIMENT

Figure 1:
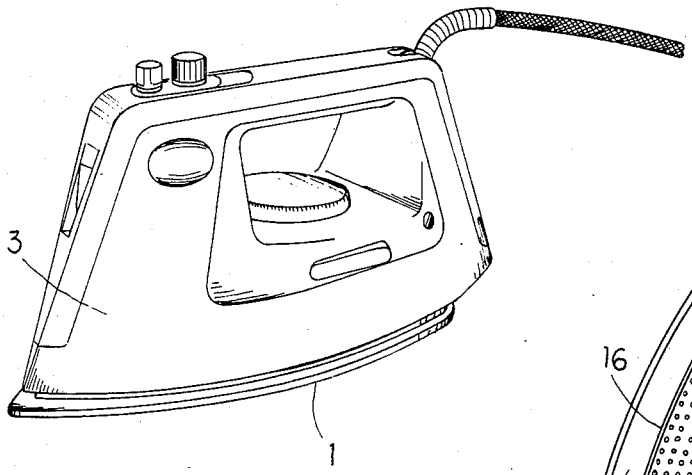
FIG. 1 shows a perspective view of a steam iron.
Figure 2:
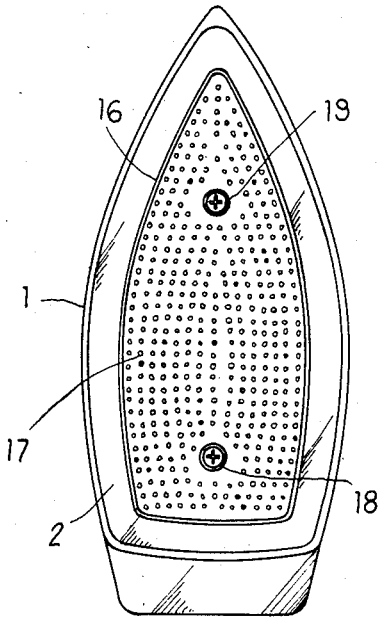
FIG. 2 shows a plan view of the undersurface of the iron of FIG. 1.
Figure 3:
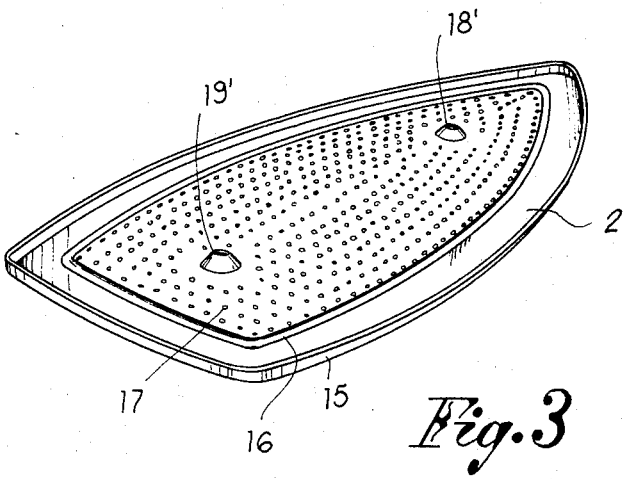
FIG. 3 shows a perspective view of a steel sheet alone when separated from the sole plate of the iron.

In the said drawings, a sole plate 1 of the iron has a perforated stainless steel sheet 2 removably attached to the base thereof.

Plate 1 is attached by known means to the body 3 of the iron, which includes a boiler for water which is to be converted to steam, and the sole plate 1 has a recess or housing 4 with a flat base defined and surrounded by a border 5 in its undersurface.

Figure 4:
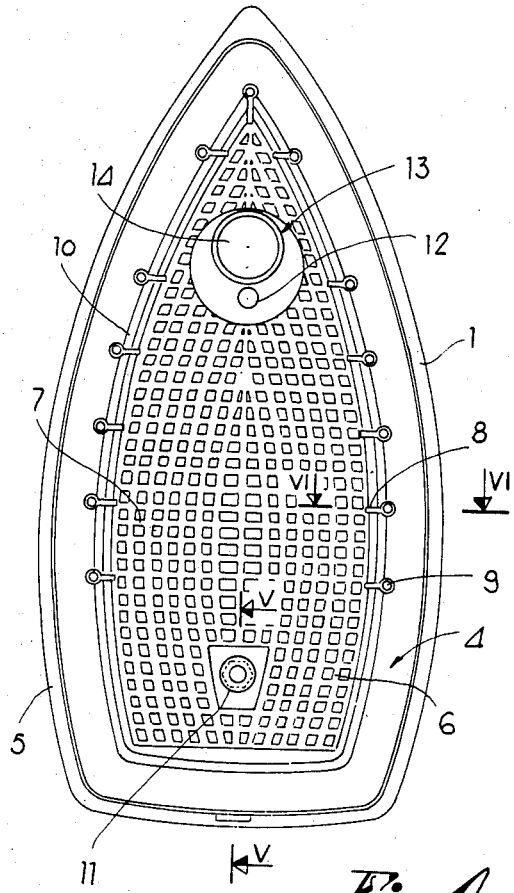
FIG. 4 shows a plan view of the undersurface of the sole plate.
Figure 6:
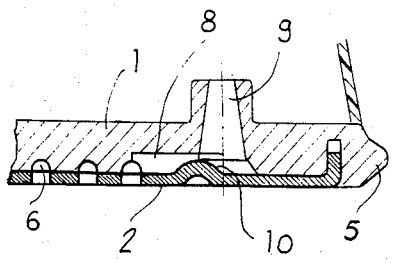
FIG. 6 shows a transverse section according to the arrows VI—VI in FIG. 4.
Figure 5:
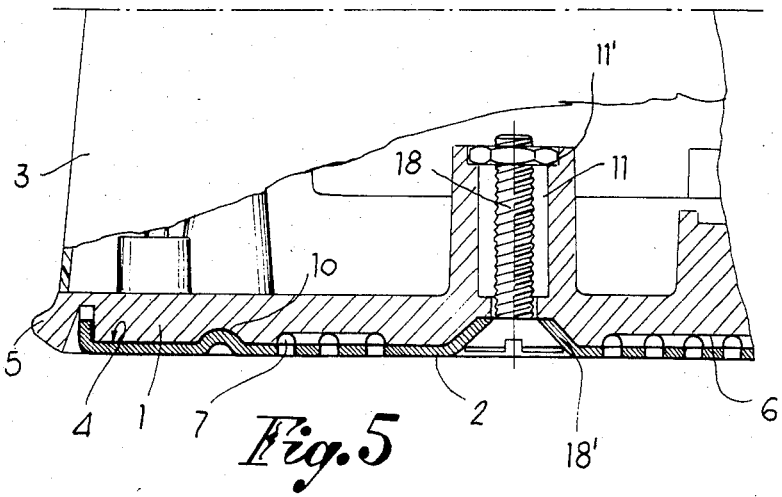
FIG. 5 shows a longitudinal section obtained in the direction of the arrows V—V in FIG. 4 of the sole plate together with the steel sheet.

A network of longitudinal 6 and transverse 7 channels is provided over the greater part of the recessed base or housing 4 (see FIG. 4) for distribution of the steam. These channels 6, 7 are in communication by means of small channels 8 leading to a plurality of holes 9 for escape of the steam, which holes 9 are provided at least along the margin of the surface supplied by the channels and connected together by means of a continuous groove 10.

In the vicinity of channels 6, 7 two holes 11 and 12 are provided to receive and retain two threaded nuts 11' and an inspection hole 13 providing access to the needle—not shown—which delivers water to the evaporating chamber which is in communication with holes 9, the inspection hole 13 being closed by a plug 14.

The stainless steel sheet 2 has a general shape identical to that of the recess or housing 4 provided in the plate and is relatively thin, having a thickness on the order of about 1 mm. The sheet 2 also has a folded edge 15 and at least one intermediate rib 16 which reinforces and stiffens the sheet. In the region defined and surrounded by rib 16 the sheet is provided with a plurality of holes 17 which, in view of the thickness of the sheet, may advantageously be made by stamping, the holes 17 being laid out in rows in accordance with the position of the longitudinal and transverse channels 6 and 7 in the undersurface of plate 1.

The stainless steel sheet 2 is seated and centered in housing or recess 4 in plate 1 and is attached thereto by means of a pair of screws 18 and 19 which pass through holes 18' and 19' in the sheet 2 itself and engage threaded nuts 11' in holes 11 and 12 in the plate 1.

The stainless steel sheet 2 when attached in this way blocks off the inspection plug 14, overlies channels 6 and 7 in the plate 1 and constitutes the effective ironing surface of the iron, thus permitting uniform and widespread distribution of the steam through corresponding holes 17. On the other hand, attachment by screws 18 and 19 allows sheet 2 to be removed easily so that it can be replaced if necessary and enables convenient access to the steam channels and also the needle, following removal of plug 14, for any maintenance or cleaning work.

I claim:

1. A steam iron comprising a sole plate on the base of which is provided a perforated stainless steel sheet, characterised in that a housing or recess bounded and surrounded by a perimeter border and having longitudinal and transverse channels for passage of steam, is provided in the undersurface of the said plate, and wherein said stainless steel sheet is seated and centered in said housing or recess and removably attached thereto, said sheet being thin and having a plurality of holes made by stamping and laid out in accordance with the channels in the undersurface of the plate, said sheet having a turned back perimeter edge and at least one intermediate reinforcing rib bounding the area containing the plurality of holes.

2. An iron according to claim 1, including removable attachment means comprising screws which pass through holes in said sheet and engage threaded holes or nuts provided in the plate.

3. A steam iron comprising a sole plate on the base of which is provided a perforated stainless steel sheet, characterised in that a housing or recess bounded and surrounded by a perimeter border and having longitudinal and transverse channels for passage of steam, is provided in the undersurface of the said plate, and wherein said stainless steel sheet is seated and centered in said housing or recess and removably attached thereto, the channels in the plate being in communication by means of small channels with a plurality of holes for delivering steam and provided at least at the margins of the area containing said channels, said holes being connected together by a continuous groove.

4. An iron according to claim 3, including removable attachment means comprising screws which pass through holes in said sheet and engage threaded holes or nuts provided in the plate.

* * * * *